US005971005A

United States Patent [19]

McKiernan et al.

[11] Patent Number: 5,971,005

[45] Date of Patent: Oct. 26, 1999

[54] VACUUM ADAPTOR FOR RECREATION VEHICLE TOILET SYSTEM WITH SLIDING CASSETTE HOLDING TANK

[75] Inventors: Edward McKiernan, Wooster; James A. Sigler, Perrysville, both of Ohio

[73] Assignee: Sealand Technology, Inc., Big Prairie, Ohio

[21] Appl. No.: 09/047,529

[22] Filed: Mar. 25, 1998

[51] Int. Cl.[6] ..... E03C 1/12

[52] U.S. Cl. ..... 137/205; 4/431; 4/441; 137/614.19; 137/899

[58] Field of Search ..... 4/431, 434, 441; 137/205, 614.19, 899

[56] References Cited

U.S. PATENT DOCUMENTS

| | | | |
|---|---|---|---|
| 4,376,315 | 3/1983 | Badger et al. | 4/431 |
| 4,776,631 | 10/1988 | Sargent et al. . | |
| 5,271,105 | 12/1993 | Tyler | 4/431 |
| 5,345,618 | 9/1994 | Sigler et al. | 4/441 X |
| 5,653,262 | 8/1997 | Hanemaayer | 137/899 |
| 5,829,471 | 11/1998 | Hofseth | 4/431 X |

FOREIGN PATENT DOCUMENTS 0 404 537 12/1990 European Pat. Off. .

OTHER PUBLICATIONS

"Thetford Cassette Toilets" commercial literature; Nov. 1995.

*Primary Examiner*—Gerald A. Michalsky
*Attorney, Agent, or Firm*—Nixon & Vanderhye P.C.

[57] ABSTRACT

A conventional recreation vehicle or caravan toilet, which normally is connected by a simple slide valve to a holding tank mounted below it, can be easily converted to a vacuum toilet at a campground or like stationary site. The holding tank is slid out of the compartment in which it is mounted below the toilet of the recreation vehicle or caravan, and a vacuum adaptor is slid into its place, making a substantially airtight connection with the toilet. The vacuum adaptor is connected up to a substantially stationary vacuum source, such as a below ground vacuum tank at a campground. The vacuum adaptor is preferably connected by a dripless connection to the vacuum source, and includes an arcuately shaped movable valve element that is rotatable about a substantially horizontal axis from a substantially airtight closed position, to an open position, when the toilet is flushed.

20 Claims, 6 Drawing Sheets

VACUUM ADAPTOR FOR RECREATION VEHICLE TOILET SYSTEM WITH SLIDING CASSETTE HOLDING TANK

BACKGROUND AND SUMMARY OF THE INVENTION

Perhaps the most common toilet system for recreation vehicles (also known as caravans) is a cassette system in which a gravity toilet is mounted above a compartment. A holding tank is slidable into and out of the compartment to mate with the bottom of the toilet. The holding tank has a sliding valve which is activated by a flush activator on the toilet. When the holding tank is slid into the compartment, channels on the holding tank engage the connection flange on the toilet to properly position the holding tank, and the actuator for the slide valve automatically engages the flush actuator. Such a system is shown in U.S. Pat. Nos. 4,776,631 and 5,031,249, the disclosures of which are hereby incorporated by reference herein.

While the heretofore described system is very successful, it can be unpleasant to use particularly at relatively long stays at a campground. The system described above requires deodorant chemical be added on a regular basis, and requires almost daily emptying, which is an unpleasant task. Therefore, it is highly desirable to be able to use an alternative to the prior art system described above when there is a relatively long stay at a campground. This would be particularly desirable for use at campgrounds having vacuum systems such as described in copending application Ser. No. 08/996,876, filed Dec. 23, 1997 (the disclosure of which is hereby incorporated by reference herein).

According to the present invention, in order to convert the low water usage, gravity toilet system as described in U.S. Pat. Nos. 4,776,631 and 5,031,249 into a vacuum system, a simple change is made to the existing system. The conventional holding tank for the system is withdrawn and not used, and the vacuum adaptor is slid into the compartment vacated by the holding tank and the same connection system is used to connect the vacuum adaptor to the connection flange of the toilet. Preferably, also the same flush actuator for the toilet can be utilized, the actuator for the vacuum adaptor movable valve automatically moving into place when the vacuum adaptor is properly aligned with the toilet. The vacuum adaptor has its own self-contained substantially airtight valve since the adaptor will be connected up to a vacuum system. The movable valve element may comprise an arcuate element that is rotated about a substantially horizontal axis when the toilet flush actuator is actuated.

According to one aspect of the present invention a method of hooking up to a substantially stationary vacuum source having at least one hookup an onboard sewage system of a recreational vehicle is provided. The recreational vehicle sewage system includes a toilet, a holding tank slide connected to the toilet, a valve mounted to the holding tank between the holding tank and the toilet, and a compartment for removably receiving the holding tank, disposed under the toilet. The method comprises the steps of: (a) Parking the recreation vehicle near the stationary vacuum source at least one vacuum source hookup. (b) Removing the holding tank from the compartment, disconnecting the holding tank from the toilet. (c) Inserting a vacuum adaptor having a substantially airtight valve into the compartment in place of the holding tank to connect the vacuum adaptor to the toilet so that when the toilet is flushed the valve is opened and sewage passes from the toilet into the vacuum adaptor. And (d) connecting the vacuum adaptor to the at least one vacuum source hookup.

Preferably the recreational vehicle has a pre-existing flush actuator for the toilet, and the vacuum adaptor valve has a valve actuator; and step (c) is practiced to connect up the valve actuator of the vacuum adaptor to the pre-existing flush actuator for the toilet (this connection preferably automatically taking place when the vacuum adaptor is slide into the compartment). Step (d) is preferably practiced using a spring biased dripless connection between the vacuum adaptor and the vacuum source hookup. Step (b) is preferably practiced by sliding the holding tank out of the compartment, and step (c) is practiced by sliding the vacuum adaptor into operative association with the toilet. The toilet typically has a connection flange, and step (c) is preferably practiced by sliding a pair of channels on the vacuum adaptor into operative contact with a connection flange. The substantially airtight valve of the vacuum adaptor includes a rotatable valve element; and the method preferably comprises the further step of flushing the toilet by effecting rotation of the rotatable valve element from a closed to an open position.

According to another aspect of the present invention a vacuum adaptor for use instead of a holding tank for a pre-existing recreation vehicle toilet, having a connection flange, is provided. The adaptor comprises: The substantially hollow body having a top, bottom, and at least one side. A connection at the body top for connecting the body to the connection flange of a recreation vehicle toilet. A substantially airtight valve in the body, and having a movable valve element disposed in operative association with the connection. An actuator for the movable valve element, disposed in part exteriorly of the body. And a vacuum source connector extending from the at least one side or bottom of the body, and configured for connection to a vacuum source.

The vacuum source connector preferably comprises a dripless connector. Preferably the actuator includes: A first actuator element rotatable about a substantially vertical axis and connectable up to a pre-existing recreation vehicle toilet flush actuator; a second actuator element rotatable about a substantially horizontal axis for rotating the movable valve element about the same substantially horizontal axis; and a valve actuator connector connecting the first and second actuator elements to translate rotation of the first actuator element into rotation of the second actuator element.

Typically the movable valve element comprises an arcuately shaped element making a seal with a sealing material (e.g. an elastomeric material) as the movable valve element moves between opened and closed positions. The movable valve element is preferably mounted for rotation about a substantially horizontal axis.

Typically the connection at the body top comprises a pair of spaced slide channel-defining elements including upper portions and lower portions. The lower portions engage the movable valve element and make sealing contact therewith. The lower portions may be elastomeric material strips. The movable valve element is preferably spring biased to a closed position.

The apparatus according to the invention preferably further comprises a vacuum source hookup disposed at a campground, and comprising one of a plurality of vacuum source hookups at the campground. The vacuum source hookup is connected to a vacuum tank at the campground, or such other structure such as disclosed in said copending application Ser. No. 08/996,876. Preferably the vacuum tank is mounted substantially below ground, and is connected to a vacuum pump.

It is a primary object of the present invention to provide a simple yet effective method and apparatus for converting a conventional recreation vehicle non-vacuum toilet system to a vacuum system at a campground or the like, so as to eliminate the necessity of manually emptying the holding tank, or adding significant amounts of deodorant chemical, while at the campground or the like. This and other objects of the invention will become clear from an inspection of the detailed description of the invention and from the appended claims.

DETAILED DESCRIPTION OF THE DRAWINGS

Figure 1:
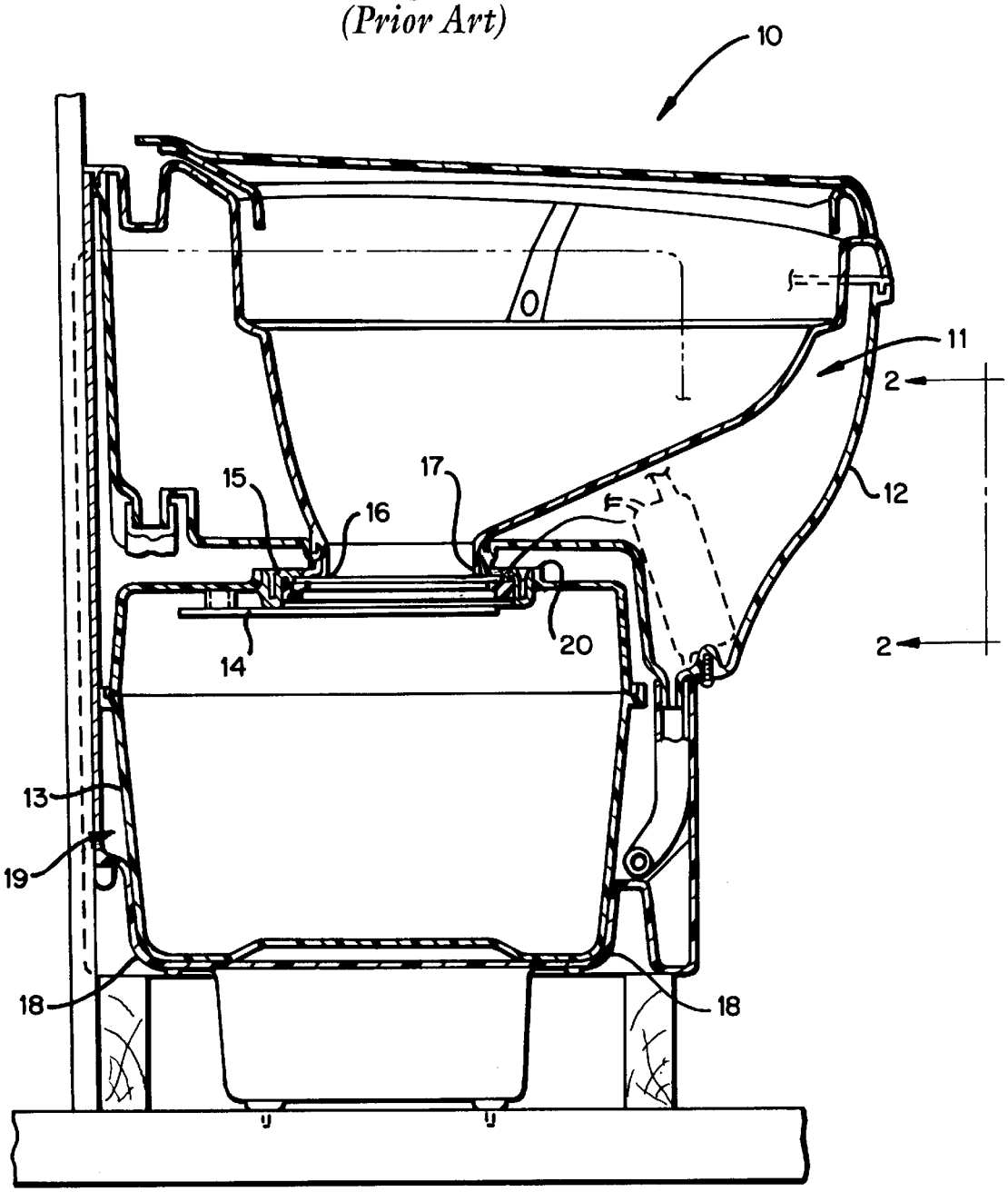
Fig. 1 (Prior Art)
FIG. 1 is a longitudinally primarily cross-sectional view of a conventional toilet system for a recreation vehicle, such as described in U.S. Pat. No. 4,776,631.
Figure 4:
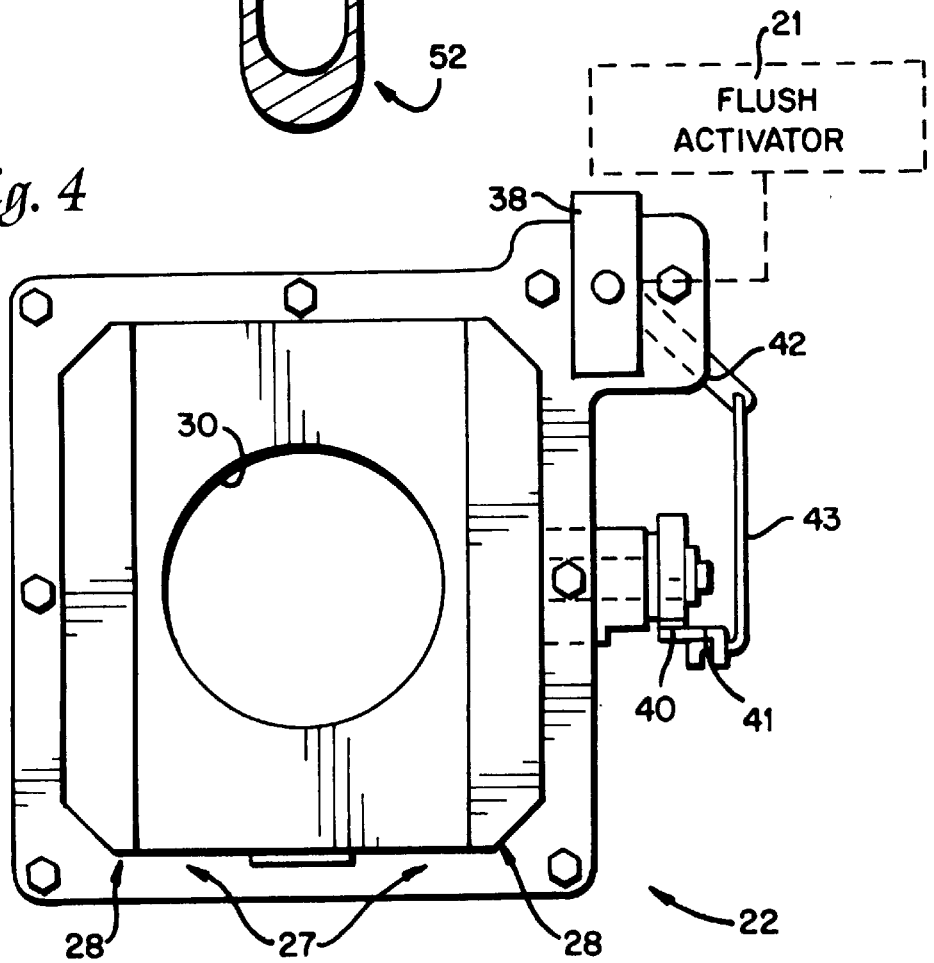
FIG. 4 is a top plan view of the vacuum adaptor per se of FIGS. 2 and 3, with the valve actuator thereof shown schematically connected to the flush actuator of the toilet.

FIG. 1 illustrates the conventional system of U.S. Pat. No. 4,776,631, FIG. 1 being comparable to FIG. 5 of that patent. The 4,776,631 patent relates primarily to a low water usage, non-vacuum, gravity toilet system 10 which includes a toilet 11 having an outer decorative casing 12, a holding tank 13 disposed beneath the toilet 11 and having a slide valve 14 for closing or opening the passageway between the toilet 11 and the holding tank 13, channel defining elements 15 which engage the connection flange 16 of the toilet 11 to properly position the holding tank 13 and slide valve 14 with respect to the toilet 11, and a tubular transition 17 between the toilet 11 and the connection flange 15. The holding tank 13 is guided at the bottom thereof by guides 18 which allow sliding movement thereof into the compartment 19 disposed below the toilet 11. A connection for the flush actuator (shown schematically at 21 in FIG. 4) for the system 10 is shown schematically at 20 in FIG. 1, the element 20 automatically and operatively connected to the flush actuator 21 when the tank 13 is moved into place with respect to the toilet 11 in the compartment 19.

Figure 2:
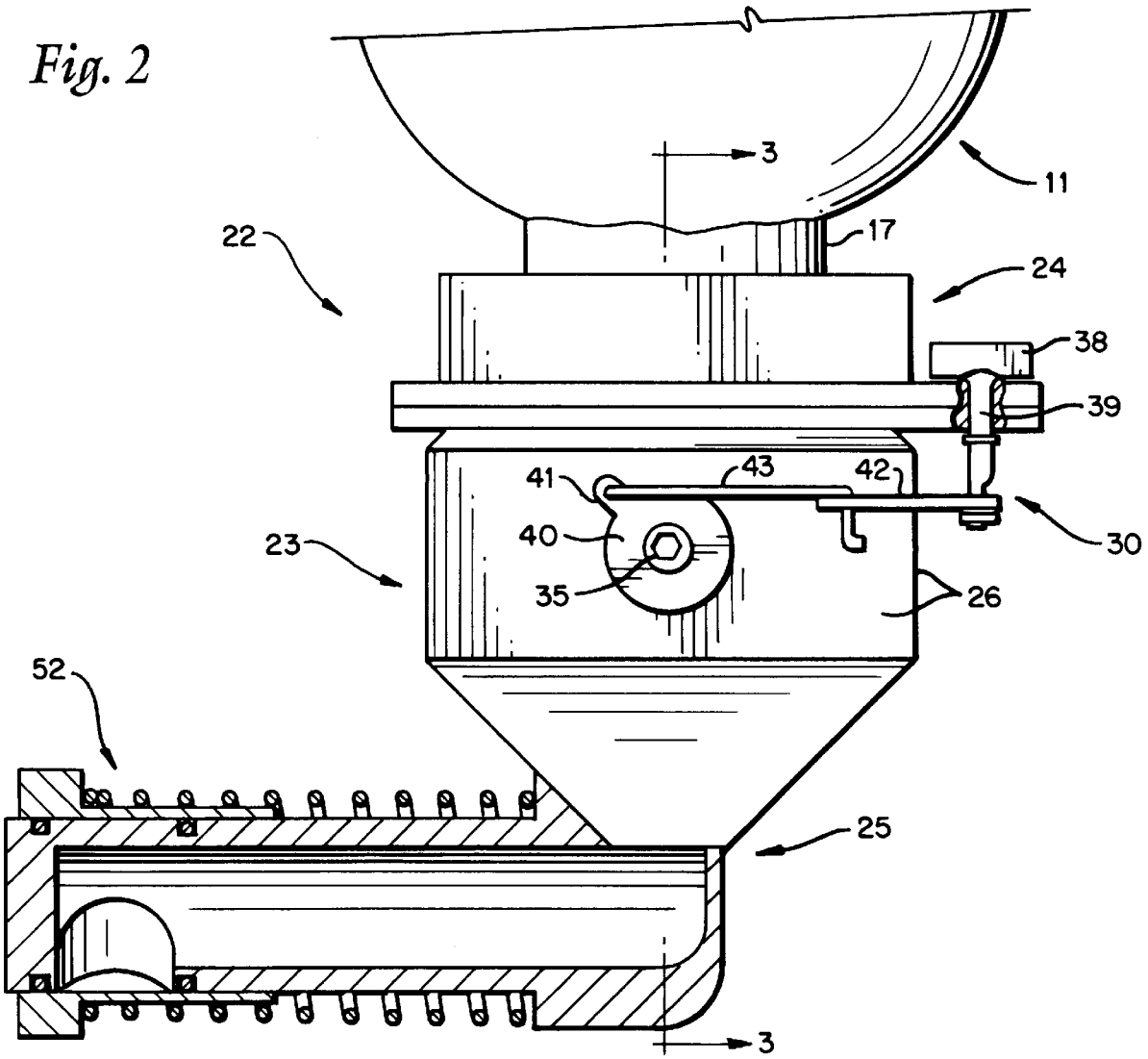
FIG. 2 is a side view, primarily in elevation but partially in cross section, of a vacuum adaptor according to the present invention in use with the toilet of FIG. 1.
Figure 3:
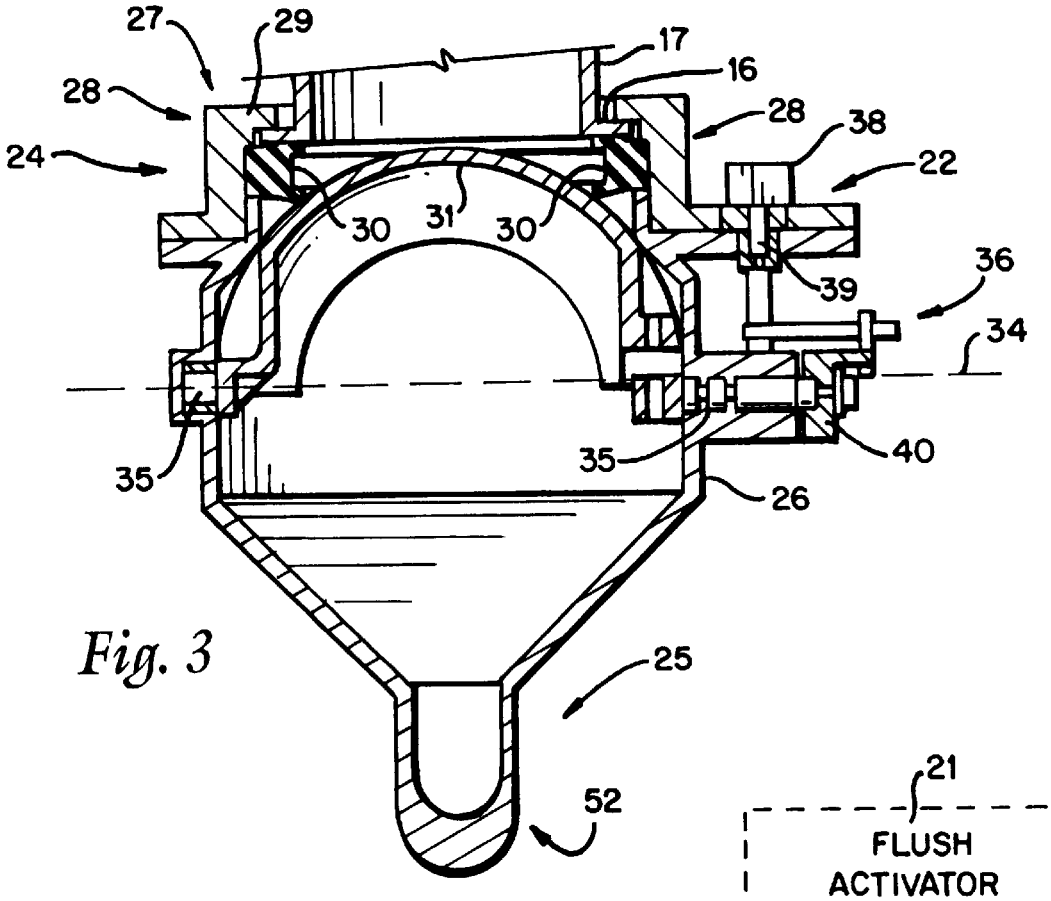
FIG. 3 is cross-sectional view taken generally along lines 3—3 of FIG. 2, but not showing the toilet.

According to the present invention, the holding tank 13 is replaced (typically temporarily) by a vacuum adaptor 22, such as illustrated in FIGS. 2 through 6. The vacuum adaptor 22 is shown mounted in association with the toilet 11 having the depending tube, in FIG. 2, and in FIG. 3 is shown in association with the depending tube 17 in the connection flange 16, although the toilet 11 per se is not seen in FIG. 3 for clarity of illustration.

The vacuum adaptor 22 includes a substantially hollow body 23 having a top 24, a bottom 25, and sides 26 (the sides 26 preferably being four flat sides, although a single continuous curved side may be provided instead). The body 23 may be made of any suitable material, preferably plastic (such as the plastic that conventional vacuum tanks for recreational vehicles or boats are made of), or corrosion resistant metal. A connection, shown generally by reference numeral 27 (see FIGS. 3 and 4), is provided at the body top 24 for connecting the body 23 to the connection flange 16. The connection 27 preferably comprises a pair of spaced slide channel defining elements 28, each including an upper portion 29 for engaging the top part of the connection flange 16, and a bottom portion 30 for engaging the bottom of the connection flange 16. The bottom portion 30 is a ring of a sealing material, preferably an elastomeric material such as silicone, rubber, or synthetic rubber.

Figure 6:
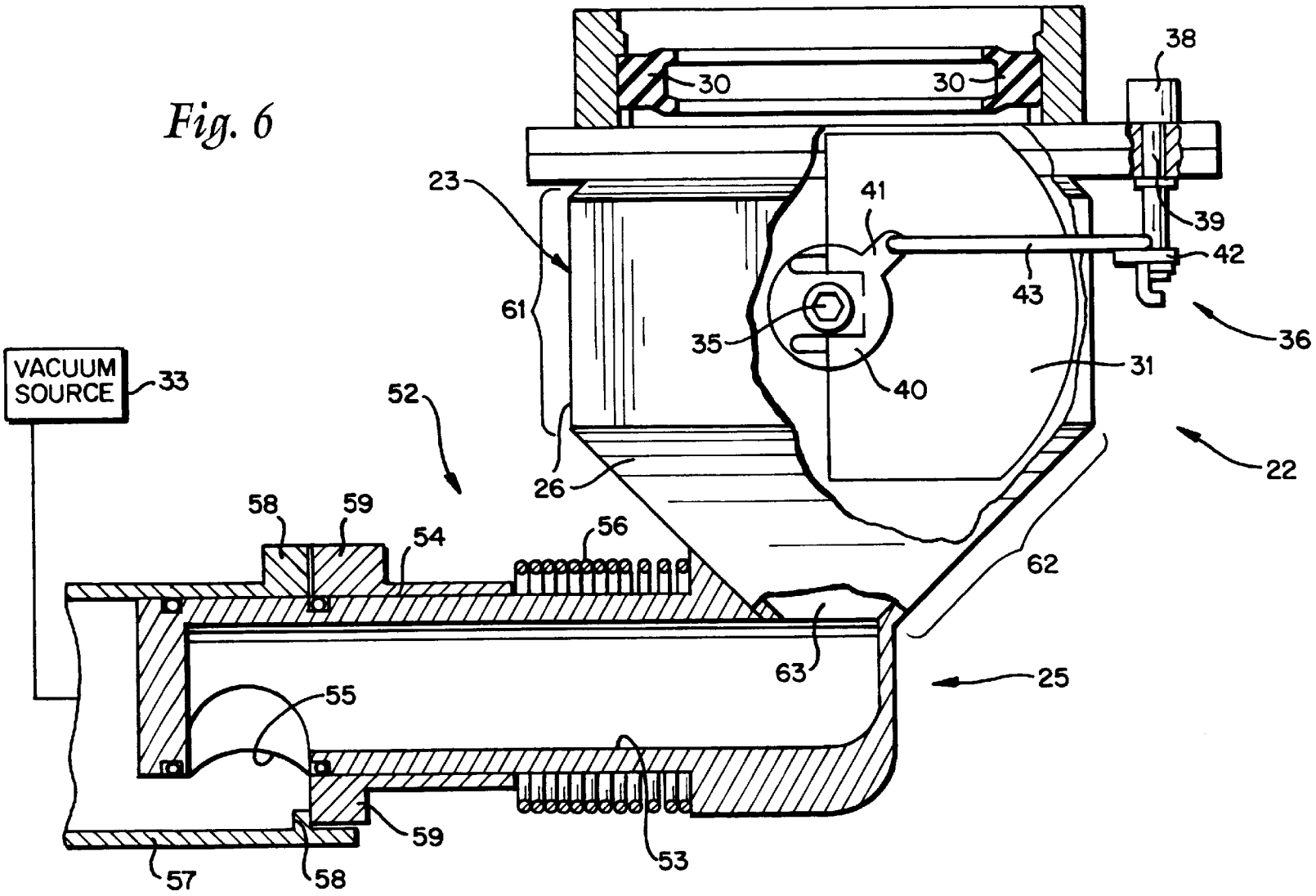
FIG. 6 is a view like that of FIG. 2 only showing the vacuum adaptor with portions cut away for clarity of illustration of the movable valve element thereof, and shown making a dripless connection with the vacuum source.

The vacuum adaptor 22 further comprises a substantially airtight valve in the body 23, including a movable valve element 31 (see FIGS. 3 and 6). As seen in both FIGS. 3 and 6, the movable valve element 31 preferably is arcuately shaped and makes a seal with a sealing material, preferably the ring defining the lower portion 30 of the channel defining elements 28, as seen in FIG. 3. A substantially airtight valve, including the movable element 31, is necessary in order to prevent erosion of the vacuum source (33 in FIG. 6) to which the vacuum adaptor 22 is connected.

While a wide variety of mechanisms can be provided for actuating the movable valve element 31, in the preferred embodiment illustrated the element 31 is rotatable about a generally horizontal axis 34 (see FIG. 3) defined by pivot pins (or shafts) 35 at opposite sides of the adaptor 22. Rotation about the axis 34 may be effected by a valve actuator, shown generally by reference numeral 36 in the drawings.

While the actuator 36 may take a wide variety of forms, the preferred form illustrated in the drawings comprises a first actuator 38 rotatable about a substantially vertical axis, e.g. defined by the shaft 39 (see FIGS. 2 and 3), and a second actuator element 40 rotatable about the substantially horizontal axis 34, e.g. by the same pivot pin or shaft 35 as the end of the element 31 closest to the actuator 36. The actuator 40 may be a disc with a radially, and axially extending arm 41 as illustrated in the drawings (see FIG. 5 in particular). The actuator 36 further comprises a valve actuator connector 41 connecting the first and second actuator elements 38, 40 together to translate rotation of the first actuator element 38 into rotation of the second actuator element 40. The valve actuator connector 41 in the preferred embodiment preferably has two parts, a first lever 42 connected to the element 38 for rotation therewith, and a second lever element 43 having a pivotal connection to the element 42 at one end thereof, and pivotally connected at the other end thereof to the radially and axially extending arm 41 of the second element 40.

Figure 5:
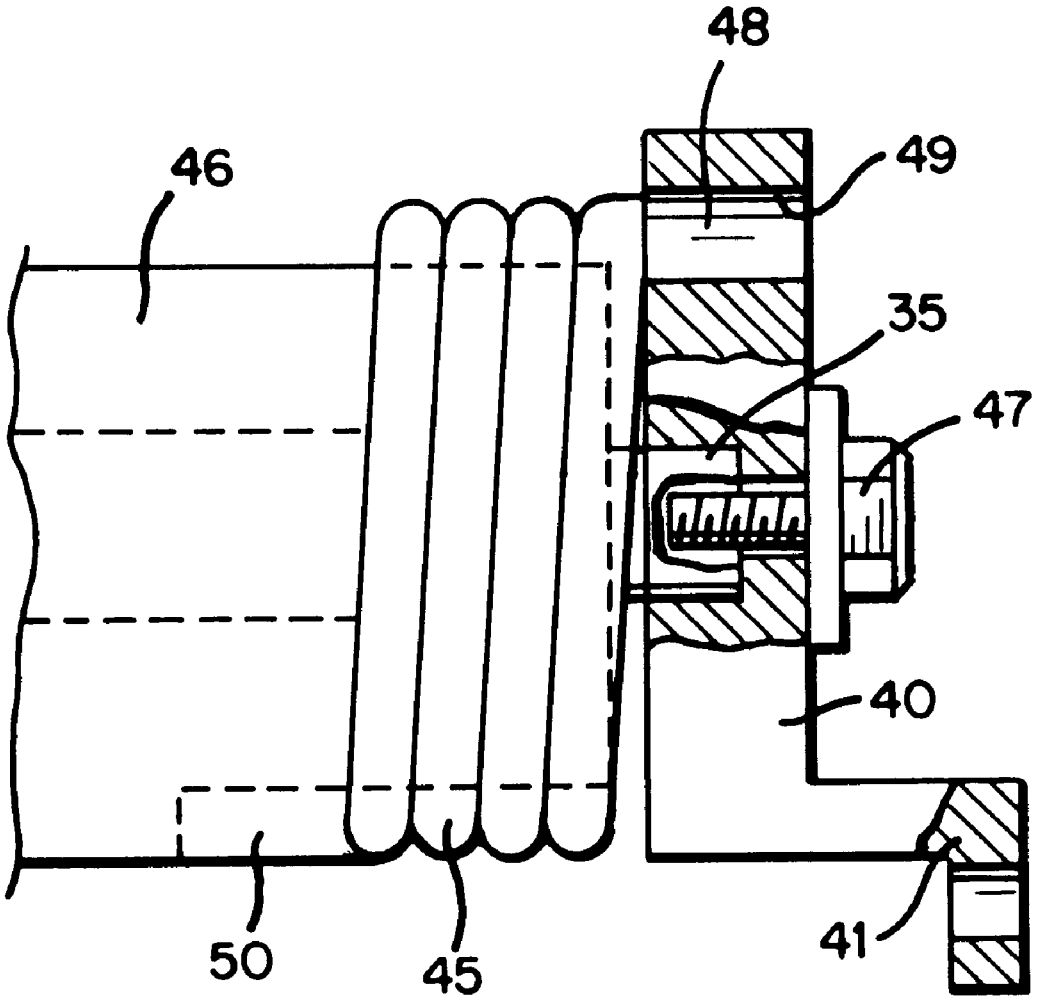
FIG. 5 is a detail top view of the spring bias for the actuator for the valve of the vacuum adaptor.

Preferably the movable valve element 31 is biased to the closed position illustrated in FIG. 3. This biasing action may be provided in a number of ways, but one particularly desirable way is to provide a torsion spring acting on the second actuator element 40 as seen in FIG. 5. The torsion spring 45 is wrapped around the exterior of the tube 46 through which the pivot pin/shaft 35 extends for mounting the element 40. The element 40 may be connected by a bolt 47 screw threaded into the pivot pin or shaft 35 as illustrated in FIG. 5. A torsion spring 45 has a first end 48 which extends through a bore 49 in a part of the element 40 offset from the arm 41, and has a second end 50 stationary with respect to the outside tube 46. As the element 40 is rotated, it is biased to the closed position of FIGS. 2 and 3 by the torsion spring 45.

FIG. 6 illustrates the actuator element 38 having been actuated so as to move the element 40 against the bias of the spring 45 to the open position for the movable valve element 31. Once the actuating force on the actuator element 38 is removed, the spring 45 returns the element 40 to the closed position.

The actuator element 38 is actuated by the already existing flush actuator 21 on the toilet. Preferably the actuator element 38 is designed to slide right into place with respect to the flush actuator 21 (which, including its connections, is shown in more detail in U.S. Pat. Nos. 4,776,631 and 5,031,249). Of course, if desired suitable modifications may be made to one or both of the element 38 and the flush actuator 21 to accommodate the vacuum adaptor 22.

The adaptor 22 further comprises a vacuum source connector, shown generally by reference numeral 52 in FIGS. 2, 3, and 6 which connects the body 23 to the vacuum source 33. The connector 52 preferably is part of a known dripless connector, such as disclosed in copending U.S. application Ser. No. 08/838,238, filed Apr. 17, 1997 (attorney docket 19-132), the disclosure of which is hereby incorporated by reference herein. In the embodiment illustrated in the drawings this includes a hollow tube 53 connected to and extending from the bottom 25 or sides 26 of the body 23 having an exterior surface over which a slide 54 slides (compare FIGS. 2 and 6) to either cover up (FIG. 2) or expose (FIG. 6) an opening 55 provided in the bottom surface of the tube 53. A coil spring 56 biases the slide 54 to the closed position (FIG. 2). A second part of the dripless connector, the tube 57, has end surface portions 58 which engage enlarged end 59 of the slide 54 to compress the spring 56, as illustrated in FIG. 6. The tube 57 is connected to the vacuum source 33.

While the body 23 may have a wide variety of shapes, the shape illustrated in the drawings is preferred, that is the body 23 having an upper section 61 that is substantially circular or square in cross section, and a bottom section 62 which is substantially conical or pyramidal, tapering to the opening 63 (see FIG. 6) which communicates with the hollow interior of the tube 53.

Figure 7:
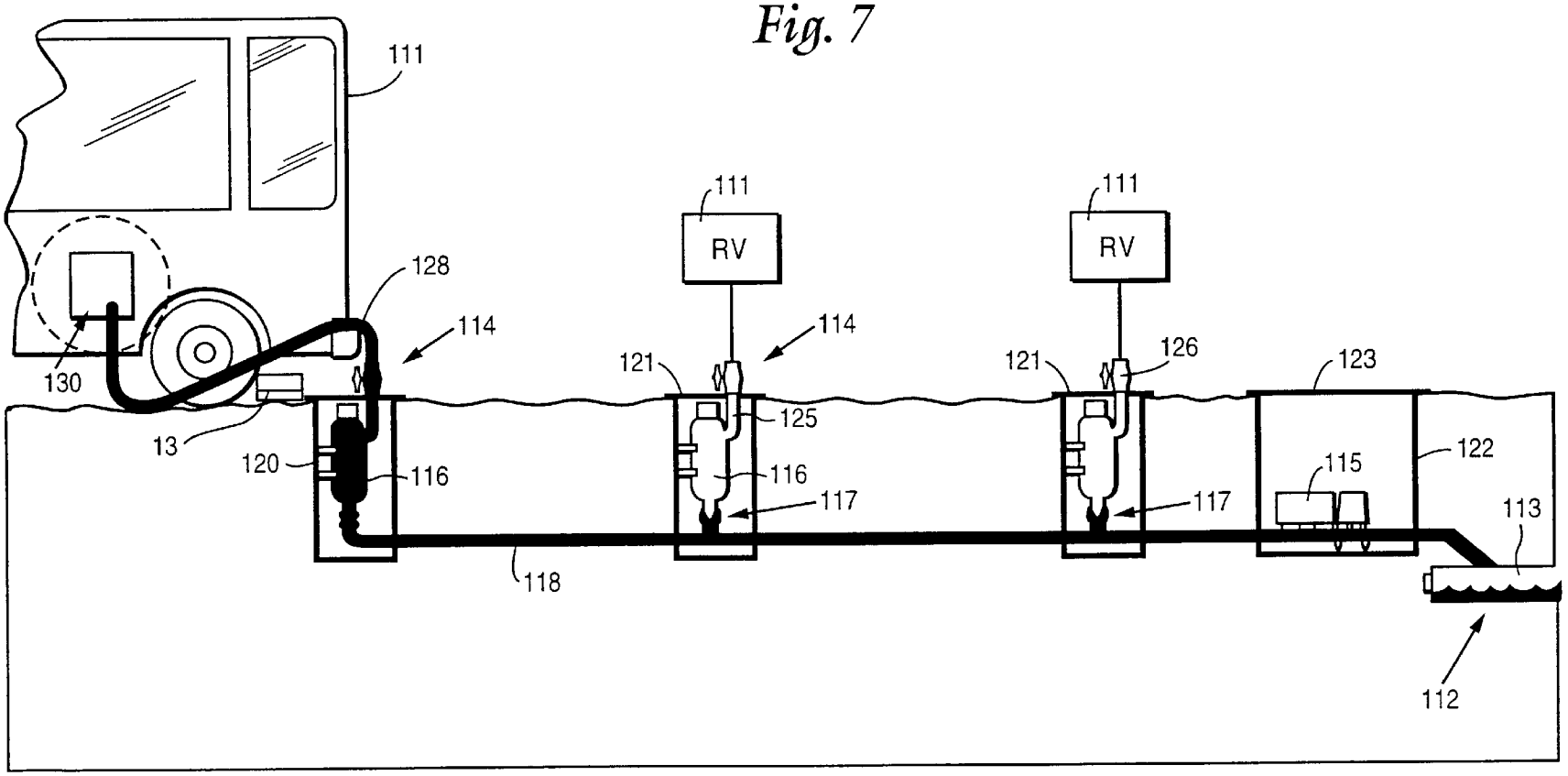
FIG. 7 is a schematic view showing a recreation vehicle having a vacuum adaptor therein according to the invention, and connected to a vacuum source at a campground.

While the vacuum source 33 may be almost any vacuum source, preferably it is the type of substantially stationary vacuum source associated with a campground as illustrated and described in copending application Ser. No. 08/996,876, filed Dec. 23, 1997. FIG. 7 schematically illustrates a connection to such a campground system for a recreation vehicle 111 which has a toilet 11 and compartment 19, and utilizes the vacuum adaptor 22, according to the invention.

FIG. 7 shows the holding tank 13 removed from the compartment 19 (which is behind the closure 130 illustrated in FIG. 7). A hole may be cut in the closure/service door 130 to allow connection of the vacuum conduit 128 to the adaptor 22 therein, while the holding tank 13 is placed underneath the vehicle 111, or otherwise is disposed in a non-use position when removed from the compartment 19.

The other components of what is illustrated in FIG. 7 include the plurality of hookups 114 each for an RV 111 site, the vacuum tanks 116 mounted below ground as in lined openings 120 covered by a cover 121 and each having a check valve 117 associated therewith, and connected to a common vacuum conduit 118 which leads to a vacuum pump 115 disposed within the below ground casing 122 covered by the cover 123. The vacuum pump 115 is operatively connected to the campground sewage system 112, which typically includes a gravity sewer pipe 113. Of course, other modifications may be provided such as shown in said copending application Ser. No. 08/996,876, filed Dec. 23, 1997, or in other suitable systems.

In the practice of an exemplary method according to the present invention the recreation vehicle 111 is driven to the campground illustrated in FIG. 7 and parked near the substantially stationary vacuum source 116 at least one hookup 114. The access door 130 is opened, and the existing holding tank 13 is removed in the conventional manner, by sliding it out of the compartment 19, and tank 13 may be disposed underneath the vehicle 111 as substantially illustrated in FIG. 7. Then the vacuum adaptor 22 is slid into place, the channel defining element 28 receiving the connection flange 16 for the toilet 11 therein. Then the dripless connector 52 is connected up to the flexible conduit 128 which is connected up to the vacuum source (vacuum tank 116, or other vacuum source 33) using another dripless connector 57. The conduit 128 may pass through an opening cut in the access door 130, so that the door 130 may be closed.

With the adaptor 22 within the compartment 19, normally the valve element 31 is closed (FIGS. 2 and 3) so that there is a relatively high pressure differential between the hollow interior of the body 23 and the hollow interior of the tube 17. However, when the flush actuator 21 is actuated, the element 38 is rotated about a substantially vertical axis, which causes the connectors 42, 43 to rotate the element 40 about the substantially horizontal axis 34, which moves the movable valve element 31 to the open position illustrated in FIG. 6 while at the same time a small amount of water is caused to flow into the toilet 11. The sewage within the toilet 11 is then pulled by the force of the vacuum in the tank 116 through the tube 17, through the body 23, through the opening 63, through the hollow interior of the tube 53, to the vacuum tank 116, and ultimately to the gravity pipe 113.

When the RV 111 user leaves the campground (e.g. typically after 24 hours or more), the adaptor 22 is disconnected from hose 128 and the adaptor 22 is slid out of compartment 19. Then tank 13 is slid back into the compartment 19 in operative relationship with toilet 11, the door 130 is closed, and the RV 111 drives away.

It will thus be seen that according to the present invention an advantageous method and system have been provided which eliminate the problems associated with having to use a deodorant chemical, and constantly dumping, a holding tank for a recreation vehicle when parked for a significant period of time (typically 24 hours or more) at a campsite or campground. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and systems.

What is claimed is:

1. A recreation vehicle comprising:

a gravity toilet having a connection flange and a holding tank removably mounted below said gravity toilet and engagable with said toilet connection flange;

a vacuum adapter utilizable in place of said holding tank, said adaptor comprising: a substantially hollow body having a top, bottom, and at least one side; an adaptor connection at said body top for readily releasably connecting said body to said connection flange of said recreation vehicle toilet; a substantially airtight valve in said body, and having a movable valve element disposed in operative association with said adaptor connection; an actuator for said movable valve element, disposed in part exteriorly of said body; and a vacuum source readily releasable connector extending from said at least one side or bottom of said body, and configured for connection to a vacuum source exterior of said recreation vehicle.

2. A recreation vehicle as recited in claim 1 wherein said vacuum source connector comprises a dripless connector.

3. A recreation vehicle as recited in claim 1 wherein said dripless connector comprises a hollow tube, a slide which slides over said hollow tube to either cover up or expose an opening provided in the bottom surface of said tube, and a spring biasing said slide to a closed position.

4. A recreation vehicle as recited in claim 1 further comprising a flush actuator for said gravity toilet; and wherein said actuator includes: a first actuator element rotatable about a substantially vertical axis and connected to said gravity toilet flush actuator; a second actuator element rotatable about a substantially horizontal axis for rotating said movable valve element about the same substantially horizontal axis; and a valve actuator connector connecting said first and second actuator elements to translate rotation of said first actuator element into rotation of said second actuator element.

5. A recreation vehicle as recited in claim 4 wherein said movable valve element comprises an arcuately shaped element making a seal with a ring of sealing material as said movable valve element moves between open and closed positions.

6. A recreation vehicle as recited in claim 1 wherein said movable valve element comprises an arcuately shaped element making a seal with a sealing material as said movable valve element moves between open and closed positions.

7. A recreation vehicle as recited in claim 6 wherein said movable valve element is mounted for rotation about a substantially horizontal axis.

8. A recreation vehicle as recited in claim 7 wherein said movable valve element is spring biaced to a closed position.

9. A recreation vehicle as recited in claim 1 further comprising a vacuum source hookup disposed at a campground, exteriorly of said recreation vehicle, and comprising one of a plurality of vacuum source hookups at the campground; and wherein said vacuum source hookup is readily releasably connected to said vacuum source exteriorly of said recreation vehicle.

10. A vacuum adaptor and vacuum source hookup as recited in claim 11 wherein said vacuum source comprises a vacuum tank mounted substantially below ground, and connected to a vacuum pump.

11. A recreation vehicle as recited in claim 1 wherein said adaptor connection at said body top comprises a pair of spaced slide channel-defining elements including upper portions and lower portions, and wherein said lower portions engage said movable valve element and make sealing contact therewith.

12. A recreation vehicle as recited in claim 11 wherein said lower portions comprise a sealing ring of elastomer material.

13. A recreation vehicle as recited in claim 1 wherein said movable valve element is mounted for rotation about a substantially horizontal axis.

14. A recreation vehicle as recited in claim 13 wherein said movable valve element is spring biased to a closed position.

15. A recreation vehicle as recited in claim 1 wherein said gravity toilet has a flush actuator; and wherein said actuator for said gravity toilet is connected to said actuator for said movable valve element.

16. A recreation vehicle as recited in claim 15 wherein said connection to said gravity toilet flush actuator comprises a first actuator element rotatable about a substantially vertical axis and connected to said gravity toilet flush actuator, wherein said actuator includes: a first actuator element rotatable about a substantially vertical axis and connected to said gravity toilet flush actuator; a second actuator element rotatable about a substantially horizontal axis for rotating said movable valve element about the same substantially horizontal axis; and a valve actuator connector connecting said first and second actuator elements to translate rotation of said first actuator element into rotation of said second actuator element.

17. A vacuum adaptor as recited in claim 15 wherein said adaptor connection at said body top comprises a pair of spaced slide channel-defining elements including upper portions and lower portions, and wherein said lower portions engage said movable valve element and make sealing contact therewith.

18. A recreation vehicle as recited in claim 17 wherein said upper portions of said slide channel defining elements engage a top surface of said gravity toilet connection flange.

19. A recreation vehicle as recited in claim 18 wherein said vacuum source connector comprises a dripless connector, including a hollow tube, a slide which slides over said hollow tube to either cover up or expose an opening provided in the bottom surface of said tube, and a spring biasing said slide to a closed position.

20. A recreation vehicle as recited in claim 19 further comprising a vacuum source hookup disposed at a campground, exterior of said recreation vehicle, and comprising one of a plurality of vacuum source hookups at the campground; said vacuum source hookup connected to a vacuum tank at said campground, and said vacuum source hookup comprises said vacuum source exterior of said recreation vehicle.

* * * * *